US005564300A

United States Patent [19]

Mueller

[11] Patent Number: 5,564,300

[45] **Date of Patent: * Oct. 15, 1996**

[54] RAM GUIDANCE MECHANISM FOR CAN BODY MAKER APPARATUS

[75] Inventor: P. Michael Mueller, Suwanee, Ga.

[73] Assignee: Aluminum Company of America, Pittsburgh, Pa.

[ * ] Notice: The portion of the term of this patent subsequent to Dec. 28, 2013, has been disclaimed.

[21] Appl. No.: 364,374

[22] Filed: Dec. 27, 1994

Related U.S. Application Data

[63] Continuation-in-part of Ser. No. 174,232, Dec. 28, 1993, Pat. No. 5,454,253.

[51] Int. Cl.[6] ..... B21D 22/28

[52] U.S. Cl. ..... 72/349

[58] Field of Search ..... 72/347, 349, 350, 72/351

[56] References Cited

U.S. PATENT DOCUMENTS

| | | | |
|---|---|---|---|
| 3,696,657 | 10/1972 | Maytag | 72/450 |
| 4,807,459 | 2/1989 | Grims et al. | 72/347 |
| 5,454,253 | 10/1995 | Mueller | 72/349 |

*Primary Examiner*—Lowell A. Larson
*Attorney, Agent, or Firm*—Thomas R. Trempus

[57] ABSTRACT

An improved can body maker apparatus has a ram system that incorporates a ram guidance mechanical linkage that supports the linear motion of the ram and translates non linear circular motion of the crank into the linear motion of the ram.

6 Claims, 6 Drawing Sheets

RAM GUIDANCE MECHANISM FOR CAN BODY MAKER APPARATUS

This application is a continuation-in-part application of U.S. patent application Ser. No. 08/174,232, Improved Redraw Mechanism for Can Body Maker Apparatus, filed Dec. 28, 1993, now U.S. Pat. No. 5,454,253 granted Oct. 3, 1995, that is assigned to the assignee of the instant application.

FIELD OF THE INVENTION

This invention relates generally to can body makers and more particularly to the ram guidance system in a can body maker. The improved system includes linkage that translates crank actuated pivotal or nonlinear motion into straight line motion.

BACKGROUND OF THE INVENTION

A conventional can body maker apparatus is disclosed in U.S. Pat. No. 3,696,657, issued to J. H. Maytag and an improvement to the ram assembly of the can body maker ram assembly is disclosed in U.S. Pat. No. 4,807,459, issued to C. M. Grims, et al. Both of these patents are assigned to Adolph Coors Company. The aforedescribed patents are incorporated herein by reference as if fully set forth. The assignee of the instant invention is also the assignee of U.S. Pat. No. 5,335,532, "Improved Body Maker Apparatus," which discloses a counterbalance mass system that facilitates improved speeds and operational efficienciens in can body makers.

Can body makers produce elongated can bodies from shallow metal cups or can shells. The can shells have a wall thickness of approximately 0.009 to 0.012 inch, and the elongated can bodies have a wall thickness reduced to approximately 0.0045 inch. In a conventional can body maker apparatus, a ram is movably mounted for reciprocal, straight line motion at rates sufficient to form from between 180 and 220 can bodies per minute. The ram can be supported for straight line, or X-axis, motion by a mounting structure that incorporates fluid bearing technology. However, because the ram is motivated by the circular motion of a crank assembly, minor elements of both Y-axis and Z-axis motion may be present in the reciprocal motion of the ram. The stroke length, that is the distance traveled by the movable ram, is between about 18 to 26 inches. As a general rule, for a given can body maker, the shorter the ram stroke, the greater the rate or number of cycles per minute at which the ram can be operated. Misalignment as small as between about 0.0005 and 0.0010 inch can result in the formation of defective cans. As can be appreciated, it is an ongoing objective of the can body maker industry to enhance the operation of the ram by minimizing to the extent possible, any transiant Y or Z axis motion in the ram.

In conjunction with the reciprocal motion of the ram, a redraw sleeve is supported in a redraw assembly. The redraw sleeve engages the shell prior to contact by the ram, applying a restraining force against the shell as the ram works the shell through a redraw die. The redraw process elongates the sidewalls of the can shell and decreases the sidewall thickness and overall diameter of the can shell. The redraw operation is followed by two or three ironing stations that further elongate and thin the walls of the can shell to form a one piece can body. Finally, the body maker can be equipped with a doming station that further forms the enclosed bottom of the can body into a desired structural configuration. Typically, mechanical linkage is provided between the main crank shaft of the can body maker and both the ram assembly and the redraw assembly.

SUMMARY OF THE INVENTION

According to this invention, an improved ram guidance mechanism includes the application of a unique linkage system that translates the motion of the crank shaft into the linear motion of the ram. This linkage substantially eliminates the presence of any transient Y-axis and Z-axis movement in the ram as it reciprocates in the body maker. The body maker apparatus includes a frame on which is supported a drive mechanism including a crank that is adapted for rotation about a first axis mounted in the frame. A ram means is mounted in a ram carriage or preferably a fluid bearing support for reciprocal, straight line motion in the frame. This invention provides a connecting straight line motion assembly that is operatively associated with the crank in order to impart reciprocal motion to the ram.

The invention is a ram guidance linkage for use in a can body maker apparatus for the manufacture of can bodies. The can body maker includes a frame; a drive mechanism including a crank adapted for rotation about a first axis located in the frame; and ram means mounted in the frame for reciprocal, straight line or X-axis motion. Link means is operatively connected between the crank and the ram means for imparting the reciprocal motion to said ram means. The ram guidance linkage is in mechanical communication with the ram means and the link means. The ram guidance linkage includes a first pivot point and a second pivot point wherein an axis is defined between the first and second pivot points. Four links of a first predetermined length form a rhombus and define in combination four pivot points at the intersection of adjacent links. A first rhombus pivot point is on the ram means. A lever arm has a first end mounted for pivotal motion about the second pivot point and a second end downwardly depends therefrom. There is mounted on the lever arm a second rhombus pivot point. Third and forth rhombus pivot points are disposed between the first and second rhombus pivot points. The second pivot point is disposed between the first pivot point and the second rhombus pivot point. Finally, first and second lateral links are connected between the first pivot point and said third and forth rhombus pivot points. As a result, the pivoting motion of the lever arm about the second pivot point is translated into the reciprocating linear motion of said ram means.

It is an object of this invention to provide an improved ram guidance system for use in a can body maker apparatus.

It is yet another object of this invention to provide an improved structure for the support and alignment of a ram while minimizing the amount of mass being reciprocated in conjunction with the can drawing operation.

It is another object of this invention to improve the speed of can body makers through reducing the number of components and the mass of the components in the ram guidance system.

BRIEF DESCRIPTION OF THE DRAWINGS

The above as well as other features and advantages of the invention can be more fully appreciated through consideration of the detailed description of the invention in conjunction with the several drawings in which.

DETAILED DESCRIPTION OF A PREFERRED EMBODIMENT

Figure 1:
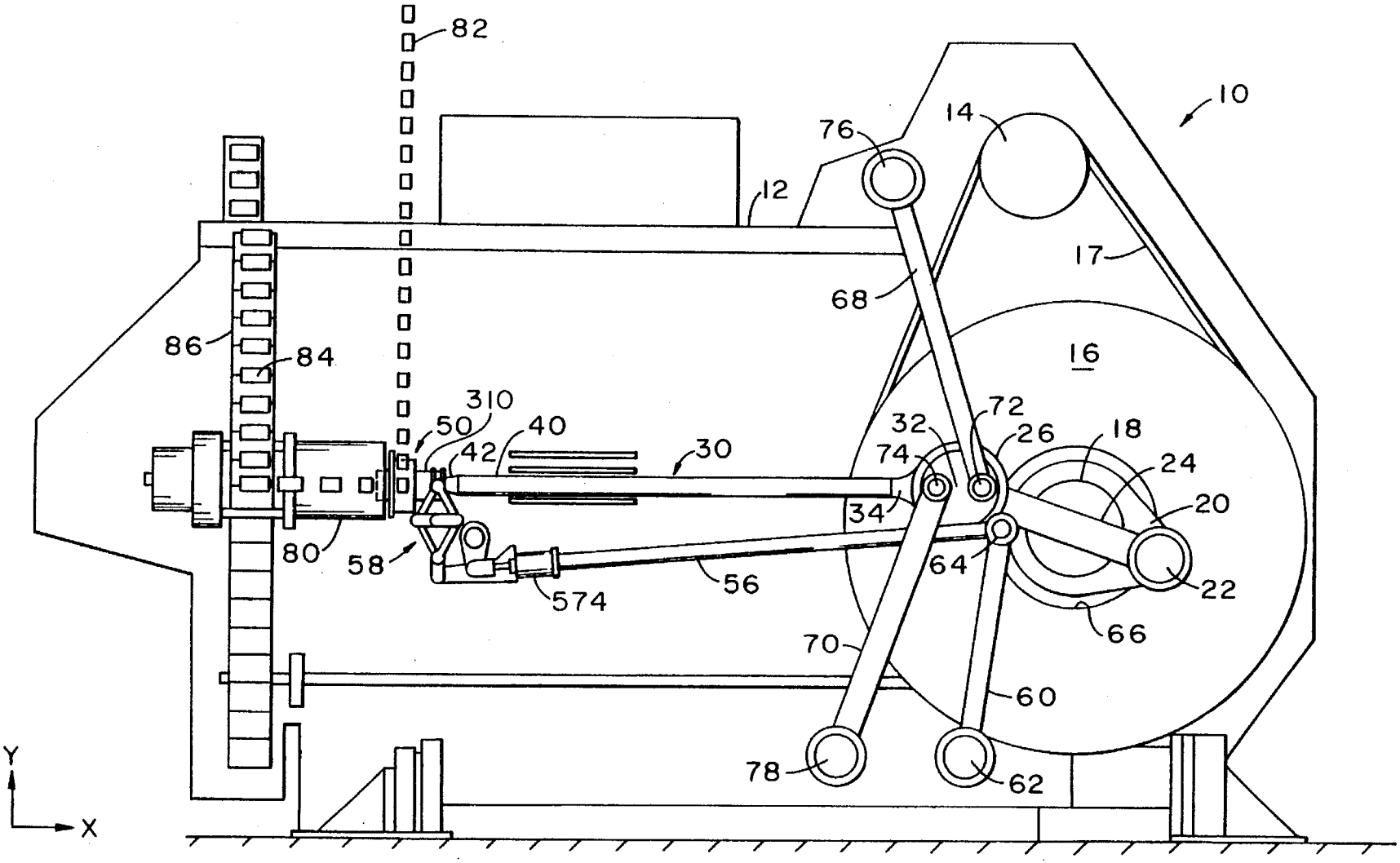
FIG. 1 is an somewhat diagrammatic view of a can body maker apparatus.

In order to fully appreciate the various aspects of this invention, it is critical to understand certain fundamental features of a typical can body maker apparatus. Turning now to FIG. 1, a can body maker is generally indicated by the reference character 10. The can body maker 10 includes a frame or housing structure 12 having mounted thereon a motor 14 that drives a large pulley wheel 16 by belt 17. The pulley wheel 16 is fixedly mounted on one of a pair of transversely extending axially aligned crankshafts 18 with crank arms 20. The crankshafts 18 are rotatable in bearings mounted in opposed sides of the frame 12. The crank arms 20 are connected together by a crank pin 22 extending through the bearings of a main connecting rod 24 which terminates at its other end in two parallel transversely spaced apart arms for engaging the circumferential surfaces of a cross head member 26, which is part of the straight line motion assembly generally designated by the reference character 30. The pivotal point of the assembly is designated 32. The cross head member 26 is engaged circumferentially by the end of a carriage connecting rod 34 by the connecting rod 24. The carriage connecting rod 34 is pivotably connected at its other end to a ram assembly 40, in which is mounted a ram or punch generally indicated at 42.

The ram or straight line motion assembly 30 of a conventional bodymaker includes a side thrust resisting, upper swing lever 68 and lower swing lever 70, both bifurcated at their inner ends so as to straddle the cross head member 26. The upper swing lever 68 is pivotably connected to the cross head member 26, as indicated at 72, and the lower swing lever 70 is pivotably connected at 74 to the cross head member 26. The upper end of the upper swing lever 68 is pivotably connected to the fixed pivots 76 on frame members 12, and the lower end of the lower swing lever 70 is pivotably connected to the fixed pivots 78 on frame members 12.

Figure 2:
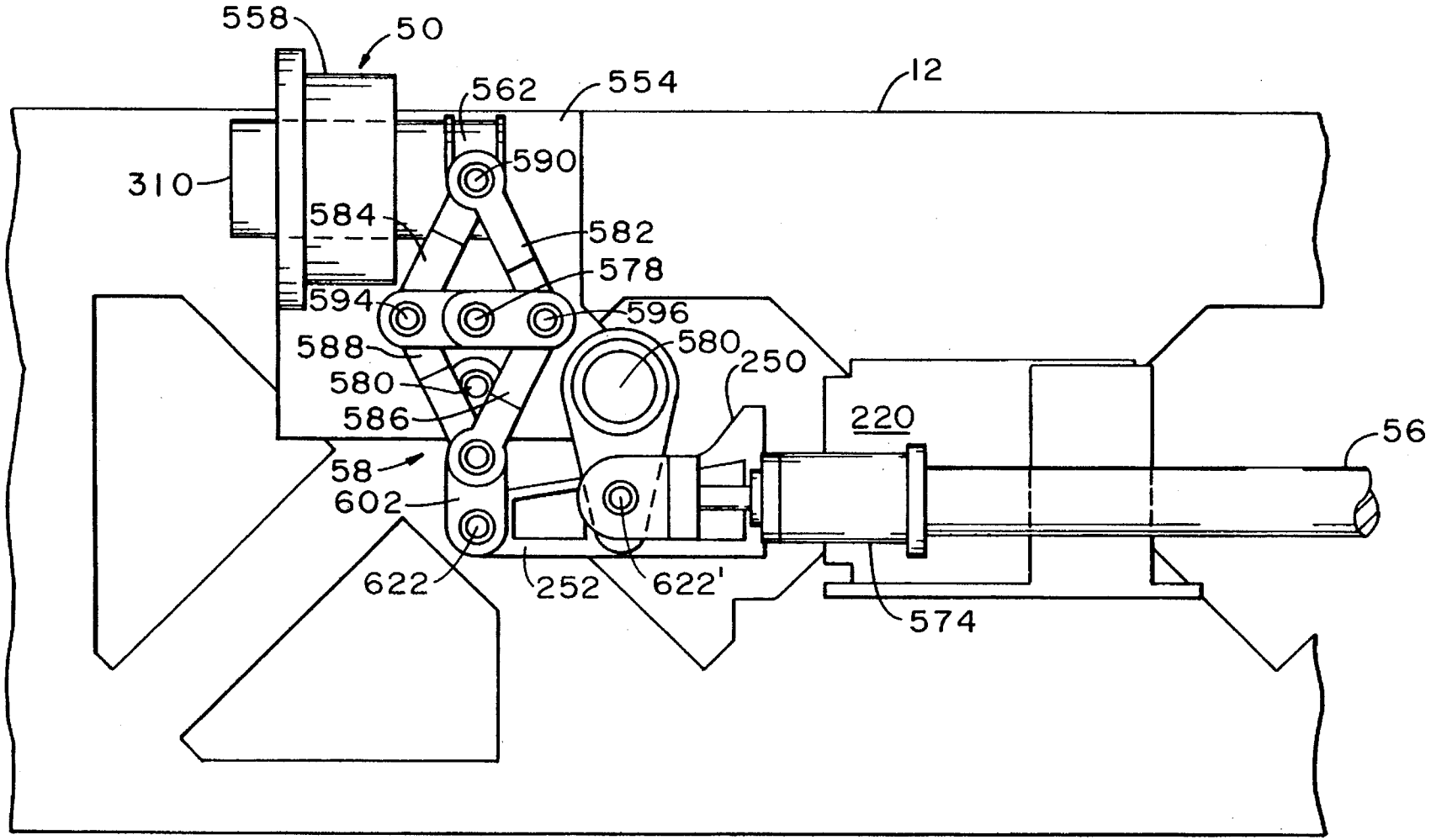
FIG. 2 is a side elevation view of redraw linkage shown in a neutral position.

A redraw sleeve supporting assembly generally indicated at 50 is located adjacent a tool pack housing 80 that is described below. A redraw sleeve 310 travels along an axis that is parallel to the ram 42 and movable in longitudinal or X axis motion independently of the ram. An actuator bar or pull rod 56 is fastened at its forward most end to a redraw system linkage generally indicated at 58 that is described below in connection with FIGS. 2 through 4, and at its rearward end (shown in FIG. 1), it is adapted to support a cam follower lever 60 which has its lower end mounted on a fixed pivot 62 on the frame 12. The upper end of the cam follower lever 60 includes a cam follower 64 for contacting the cam surface on the crank assembly. The rotary action of the crank 20 is translated into the reciprocal motion of the redraw sleeve 310.

A tool pack housing 80, mounted in the front, or left hand portion of the can body maker as illustrated in FIG. 1, encloses a series of drawing and ironing dies (not shown) through which a work piece such as a shallow cup 82 is worked by the ram in combination with the redraw assembly 50. The cup 82 is drawn and ironed into a can body 84 and a suitable transport system 86 conveys the can body 84 from the body maker 10 for further processing. The redraw operation is the most critical function in the can making process. The redraw assembly 50 is located in front of the ram assembly 40 and next to the die housing assembly 80. The redraw assembly 50 performs the redraw operation and provides the alignment structure for the redraw sleeve 310. Generally, the redraw sleeve 310 aligns the metal cup 82 during the drawing operation and provides the correct pressure to the metal cup holding it against the redraw die face of the tool pack 80 as it is worked by the ram.

Considering FIGS. 1 through 4, the improved redraw system 50 supports a redraw sleeve 310 in an support housing 554. The redraw sleeve reciprocates in the support housing along an X axis. The reciprocal movement is relative to the forward portion of the ram. The independent movement of the redraw sleeve assembly occurs in conjunction with and in a timed fashioned with respect to the motion of the ram assembly. A redraw sleeve support housing 554 is fixedly mounted to the frame structure 12 of the body maker 10. The housing 554 includes a bore therein adapted to receive and retain a fluid bearing 558. A redraw sleeve 310 is supported within the fluid bearing 558 for linear axially reciprocal motion therein. A redraw sleeve engaging collar 562 is removably connected to the sleeve 310 by means of a bayonet mount structure. The bayonet mount provides flexibility in the redraw assembly within preset limits of excursion. The redraw linkage mechanism 58 is pivotably connected to the collar 562 at pivot point 590 so that the actuating mechanism transmits motion only to the collar 562 and sleeve 310. The redraw sleeve supporting housing 554 and redraw sleeve fluid bearing 558 remain stationary. The redraw sleeve 310 is maintained in axial alignment by means of the fluid bearing 558. The ram 42 passes through the bore of the redraw sleeve.

Figure 3:
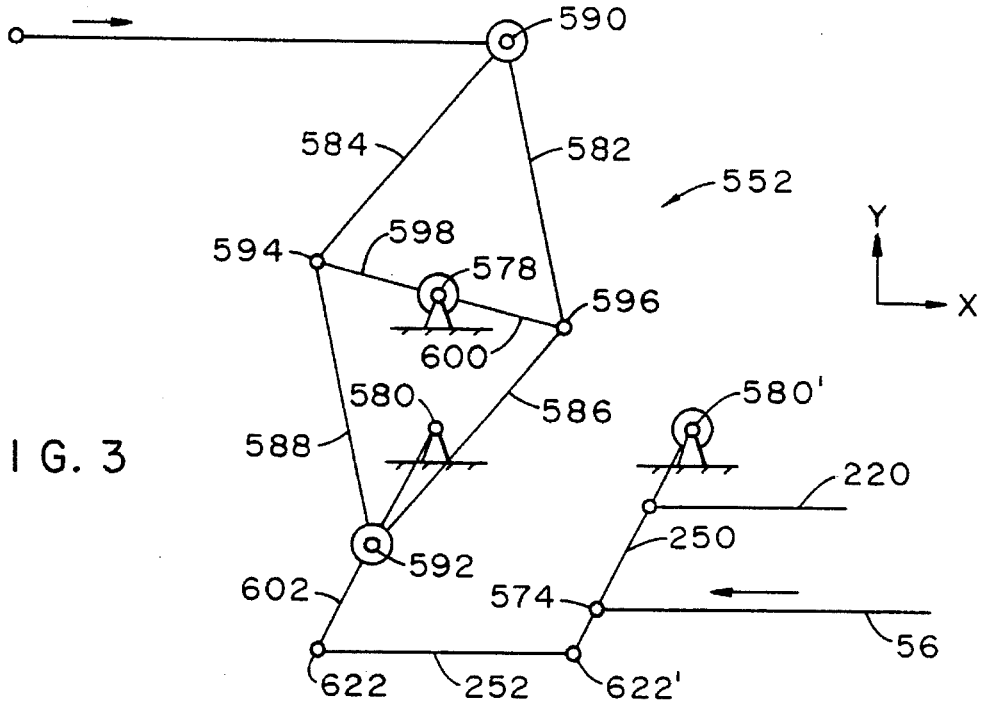
FIG. 3 is a schematic representation of the redraw linkage of this invention, illustrating the X axis motion thereof in the retracted position.

The forward and retract motion for the redraw sleeve and redraw sleeve collar 562 are effected by the high-low rotation of the redraw cams generally indicated at 66 and actuating rod 56 as described above. The non-linear, reciprocating motion of the actuating rod 56 is translated into the linear motion of the redraw sleeve 310 by means of the linkage generally indicated by the referenced character 58. The operating principles of this linkage will be described in conjunction with the detailed schematic representation of the mechanical linkage as shown in FIG. 3. It should be appreciated that while the mechanical linkage is being described in terms of relatively simple links on one side of the redraw assembly, linkage is provided on both sides of the redraw sleeve collar 562. Likewise, as the actuating rod 56 is discussed as being a single rod on one side of the can body maker, in practice, a pair of complementary rods, each disposed to one side of the can body maker center line provide additional balance to the system and to minimize any bending moment in the redraw linkage. Additionally, the biasing means is mounted along the center line of the body maker, below the ram. The redraw actuating mechanism 58 is in communication with the actuating bar 56 by means of a pre-load assembly 574. A biasing means 210 maintains the actuating rod 56 in tension and the cam follower in contact with the cam surface throughout the high-low rotation of the redraw cam system.

The redraw actuating mechanism includes a first, fixed pivot point 578 on the frame 12 of the body maker 10. A second fixed pivot point 580 is also mounted in the frame 12 of the body maker. An axis extending between the first pivot point 578 and the second pivot point 580 is preferably perpendicular to the linear motion of the redraw sleeve 310 and collar 562. However, as will be appreciated, this relationship need not be perpendicular. Four links 582, 584, 586, and 588 are equal in length and form a rhombus. These four links define in combination, four pivot points at the intersection of adjacent links. The first pivot point 590 of the four pivot points formed by the rhombus of the four equal links 582–588 connects the linkage assembly 552 to the collar 562 of the redraw sleeve assembly 50. Two links 598 and 600 of equal length connect two additional pivot points 594 and 596 of the rhombus to the fixed pivot point 578. When in a neutral position such that its axis extends through movable pivot points 590 and 592 and fixed points 578 and 580, fixed pivot point 580 is mid-way between first fixed pivot point 578 and rhombus movable pivot point 592. A lever arm 602 extends from pivot point 580 through movable pivot point 592. It is to be appreciated that the specific locations described above can be varied to produce amplifications or de amplifications to the ratios of movement.

Figure 4:
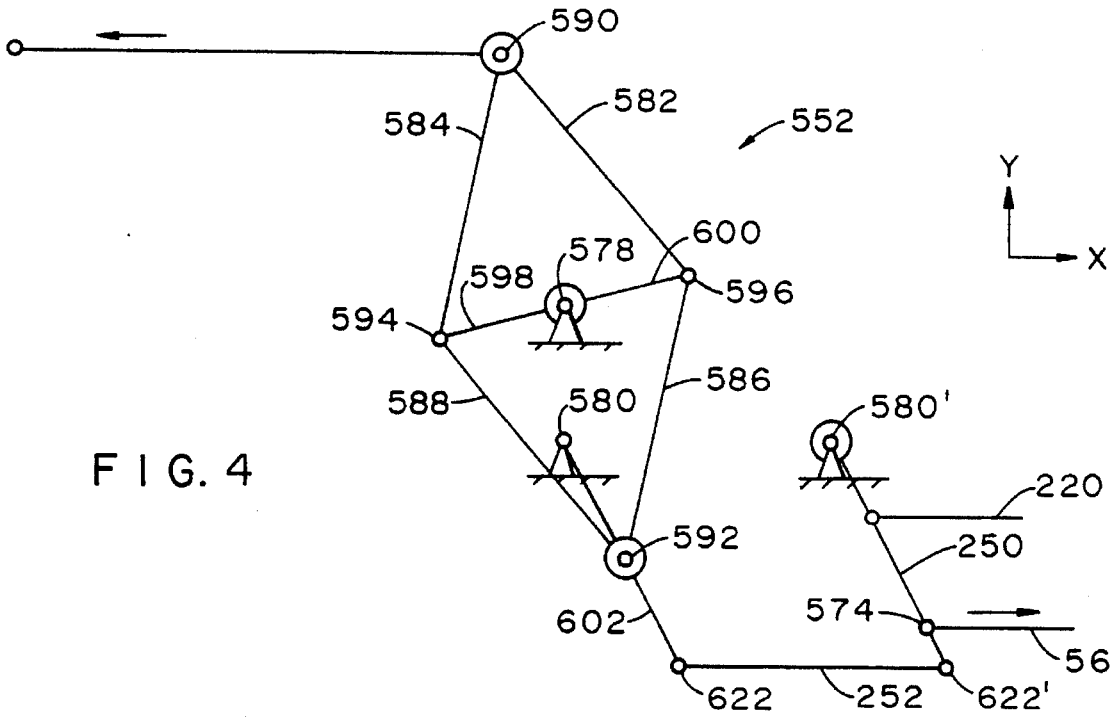
FIG. 4 is a schematic representation of the redraw linkage of this invention, illustrating the X axis motion thereof in the extended position.

In operation, when the lever arm 602 is in its forward most position as shown in FIG. 3, the redraw sleeve is in its retract position. Likewise, when lever arm 602 is in its rearward most position as shown in FIG. 4, the redraw sleeve is in its forward most position engaging a shallow cup. As lever arm 602 pivots about second fixed pivot point 580, the pivot point 590 associated with the redraw sleeve collar 562 is compelled to move in a straight line perpendicular to the neutral or center position of pivot points 590, 578, 580 and 592.

The actuating rod 56 is connected to the redraw linkage 58 by means of a preload mechanism 574. In a preferred embodiment, the biasing means 220 is connected to the redraw linkage 552 at link 250. Alternatively, the preload mechanism 574 can be directly connected to the link member 602, thus eliminating links identified by reference characters 252 and 250.

Returning to the preferred embodiment, link 250 and lever arm 602 form a parallel linkage connected by link 252 at pivot points 622 and 622'. Two fixed pivot points 580 and 580' are located in the body maker frame structure. The parallel linkage pivots about fixed pivot points 580 and 580'. The parallel linkage structure functions as the connecting point for the biasing means and the actuating rod. (Pivot points 574 and 622' can be the same two physical connecting point or can be removed from each other. The location of the pivot point 622' is based on the parallel structure of its associated linkage. The selection of the location of the pivot/connecting point 574 can be made in response to system requirements and the modifications to the desired travel of the parallel linkage relative to the actuating rod 56.) The forward and rearward motion of the parallel linkage, and thus the lever arm 602, is effected by a combination of the reactive forces of the biasing means 220 urging the linkage 552 forward and the cam driven actuating rod 56 pulling the parallel linkage, and thus the arm 602, rearwardly.

Figure 5:
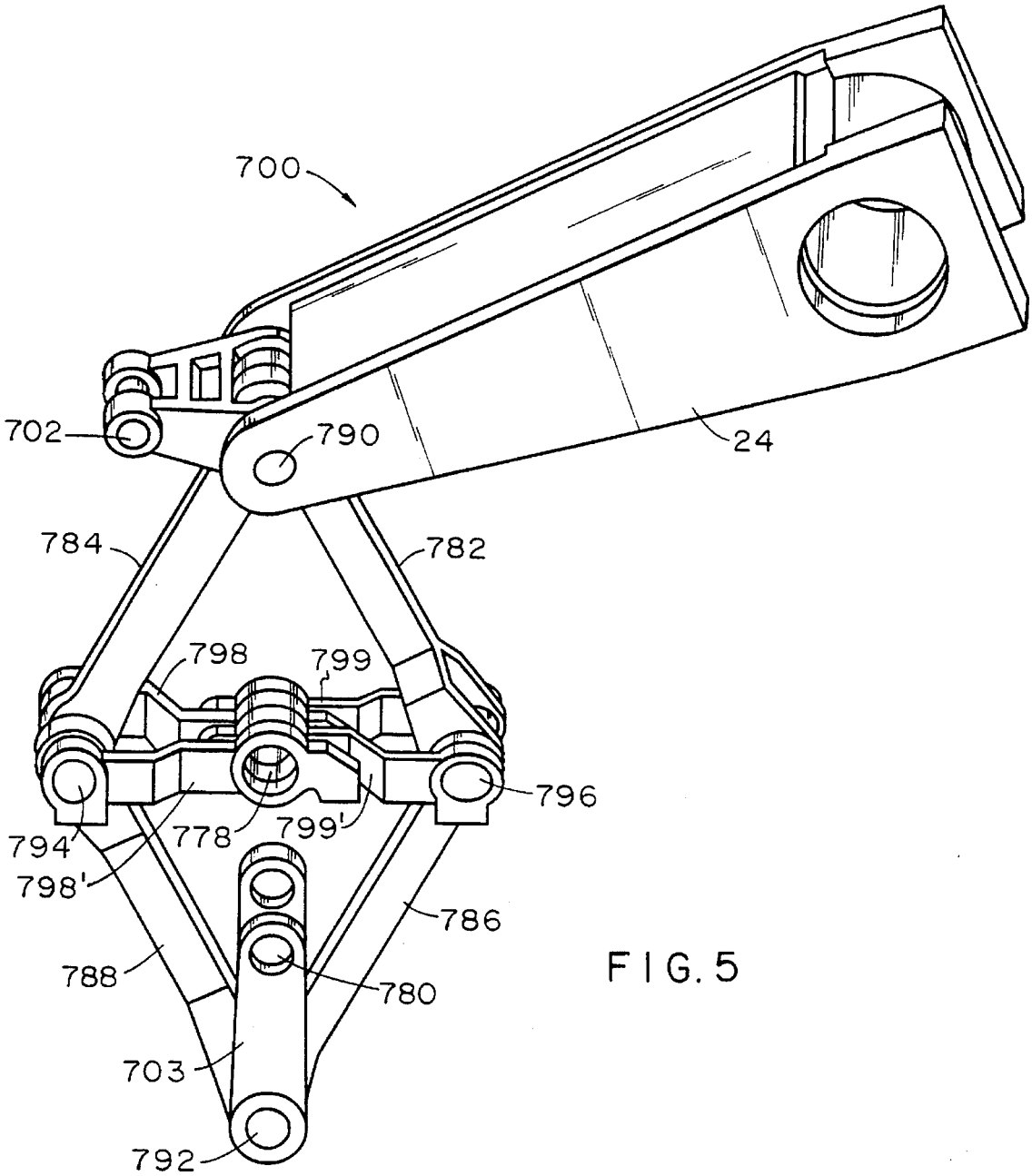
FIG. 5 is a perspective view of portions of the ram linkage shown in a neutral position.
Figure 6:
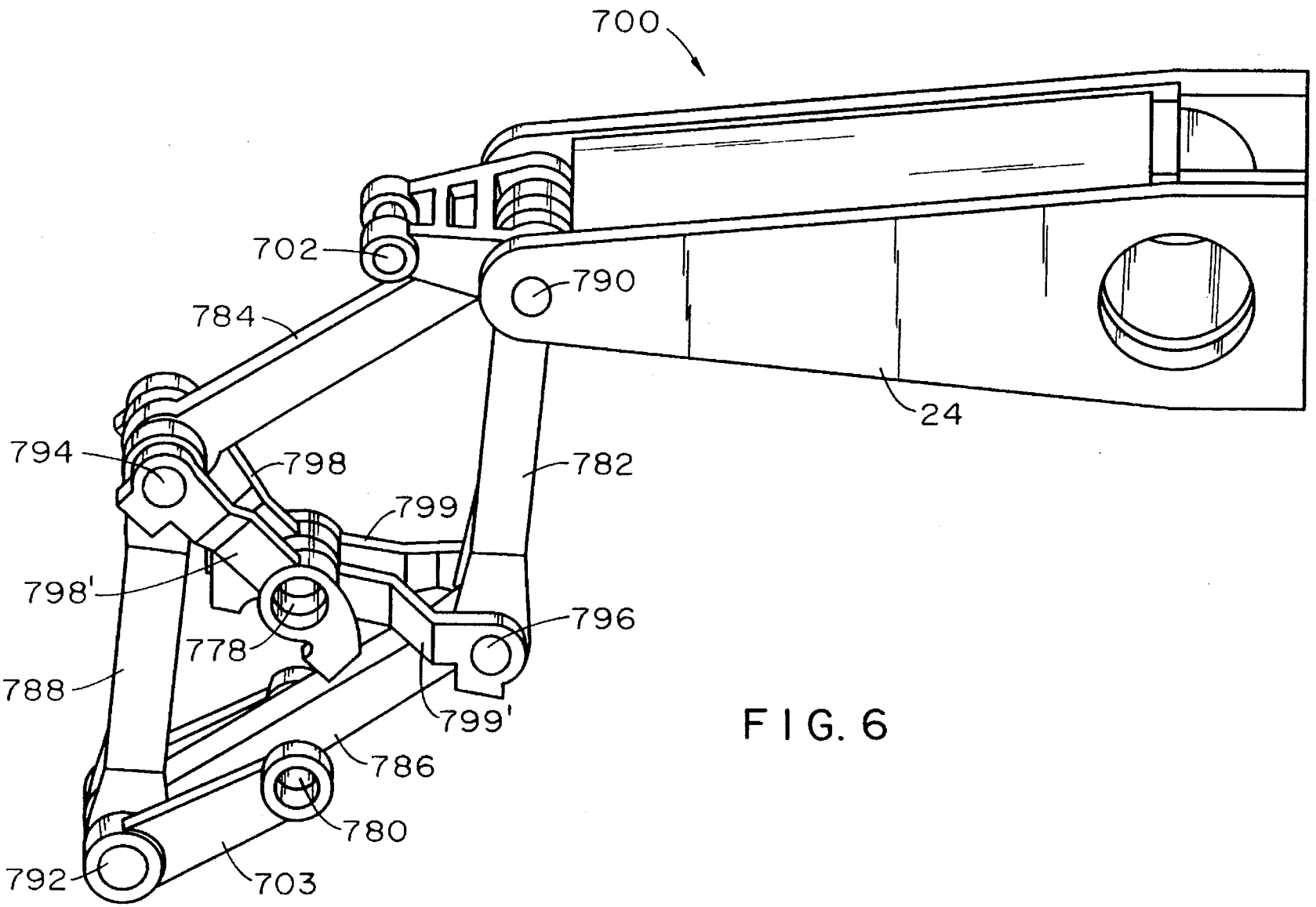
FIG. 6 is a perspective view of portions of the ram linkage shown in a retracted position in which the ram is withdrawn from the drawing and ironing dies.

The improved ram guidance mechanism according to this invention is illustrated in FIGS. 4, 5 and 6. It is to be appreciated that this linkage is used in place of the straight line motion linkage previously described in conjunction with FIG. 1. Accordingly upper and lower arms 68 and 70 as well as member 32 are eliminated. In place of these eliminated elements, the straight line motion assembly is generally indicated by the reference character 700. It is interconnected between the main connecting rod 24 and the ram 40 (shown in FIG. 1) where in a conventional straight line assembly, the ram 40 would be interconnected to a cross head member 26, the ram 40 is connected to the straight line motion assembly 700 of the instant invention by means of a cleaves pin 702. In other respects as described above, the ram 40 is supported in a fluid bearing mechanism or the like for reciprocal motion. The ram guidance linkage 700 translates the rotational movement of the crank arms 20 into reciprocal straight line motion necessary for the actuation of the ram 40.

Figure 7:
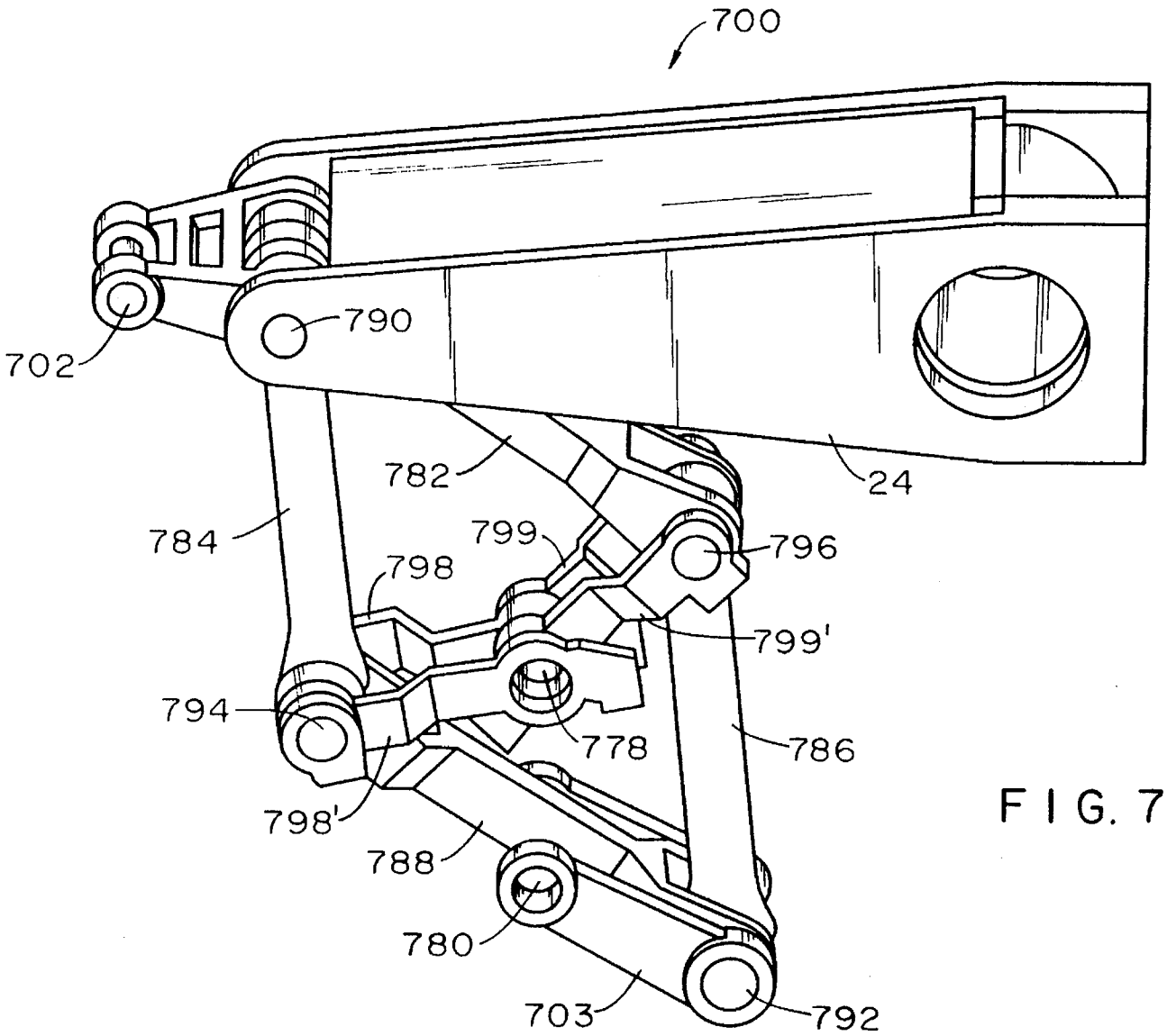
FIG. 7 is a perspective view of portions of the ram linkage shown in the extended position in which the ram is penetrating the drawing and ironing dies.

The ram guidance mechanism includes a first, fixed pivot point 778 on the frame 12 of the bodymaker 10. A second fixed pivot point 780 is preferably perpendicular to the linear motion of the ram 40. However, as will be appreciated, this relationship need not necessarily be perpendicular. Four links 782, 784, 786 and 788 are equal in length and form a rhombus. These four separate links define in combination four pivot points at the intersection of adjacent links. The first pivot point 790 of the four pivot points formed by the rhombus of the four equal links 782 through 788 connects the linkage assembly 700 to the crank arm 24. Two links 798 and 799 of equal length connect to additional pivot points 794 and 796 of the rhombus to the fixed pivot point 778. When in a neutral position such that its axis extends through movable pivot points 790 and 792 and fixed points 778 and 780, fixed pivot point 780 is midway between first fixed pivot point 778 and rhombus movable pivot point 792. A lever arm 703 extends from pivot point 780 that is the fixed pivot point on the frame of the bodymaker to movable pivot point 792. It should be appreciated that the specific locations described above can be varied to produce amplification or deamplifications to the ratios of movement. In operation, when the crank arm 24 is in its forward most position as shown in FIG. 7, the ram is likewise in its forward most position penetrating the drawing and ironing dies of the tool pack 80. Likewise, when the arm 24 is in its rearward most position as shown in FIG. 6, the ram 40 is in its rearward most position disengaged from the drawing and ironing dies 80. In operation, the pivot point 790 defined by links 784 and 782 travels on an X-axis path that is parallel with the X-axis motion of the ram member 40. Thus, the Y-axis motion of the arm 24 is converted into the linear X-axis motion required for ram operation.

As can be seen from FIGS. 4, 5 and 6, the linkage mechanism can provide multiple links members on such as at members 799 and 799 primed and 798 and 798 primed. The members 788 can be formed with cleaves like connections so as to permit the mounting of member 784 there in between as at the pivot point 794.

The present invention has been described in an illustrative manner. It is to be understood that the terminology which has been used is intended to be in the nature of words of descriptive rather than limitation. Many modifications and variations of the preset invention are possible in light of the above teachings. Therefore within the scope of the appended claims, the present invention may be practiced otherwise than as specifically described.

What is claimed is:

1. An apparatus for the manufacture of can bodies having:

(a) a frame;

(b) drive mechanism including a crank adapted for rotation about a first axis located in said frame;

(c) ram means mounted in said frame for reciprocal, straight line motion;

(d) link means operatively connecting said crank with said ram means for imparting reciprocal motion to said ram means;

(e) ram guidance linkage in mechanical communication with said ram means and said link means; said ram guidance linkage including:

(i) a first pivot point (578);

(ii) a second pivot point (580) wherein an axis is defined between said first and second pivot points (578 and 580);

(iii) four links (582, 584, 586, 588) of a first predetermined length forming a rhombus and defining in combination four pivot points at the intersection of adjacent links, wherein a first rhombus pivot point (590) is on the ram means;

(iv) a lever arm having a first end mounted for pivotal motion about said second pivot point (580) and a second end downwardly depending therefrom, and on which lever arm is mounted a second rhombus pivot point (592), and wherein a third and forth rhombus pivot points (594 and 596) are disposed between said first and second rhombus pivot points; said second pivot point (580) being disposed between the first pivot point (578) and the second rhombus pivot point (592); and (v) first and second lateral links (598 and 600) connected between said first pivot point (578) and said third and forth rhombus pivot points (594 and 596), wherein the pivoting motion of said lever arm about said second pivot point (580) is translated into the reciprocating linear motion of said ram means.

2. The apparatus according to claim 1 wherein the first and second pivot points are in fixed locations in the can body maker frame, and the axis defined between the first and second pivot points is generally perpendicular to the linear motion of said ram means.

3. The apparatus according to claim 1 wherein the ram means includes a fluid bearing means mounted in the can body maker and the ram means is movably mounted in said fluid bearing means for reciprocal straight line motion.

4. A ram guidance linkage apparatus for imparting reciprocating linear motion to a ram mounted for reciprocal movement in a can body maker apparatus comprising:

(i) a first fixed pivot point;

(ii) a second fixed pivot point wherein an axis extending between said first and second pivot points and is perpendicular to the linear motion of said ram;

(iii) four links having predetermined length forming a rhombus and defining in combination four pivot points at the intersection of adjacent links, wherein a first rhombus pivot point is on the ram;

(iv) a lever arm having a first end mounted for pivotal motion about said second pivot point and a second end downwardly depending therefrom, and on which lever arm is mounted a second rhombus pivot point, and wherein a third and forth rhombus pivot points are disposed between said first and second rhombus pivot points; said second pivot point being disposed between the first fixed pivot point and the second rhombus pivot point;

(v) first and second lateral links connected between said first fixed pivot point and said third and forth rhombus pivot points, wherein the pivoting motion of said lever arm about said second fixed pivot point is translated into the reciprocating linear motion of said ram.

5. A linkage apparatus for imparting reciprocating linear motion to a ram mounted for reciprocal movement in a can body maker apparatus comprising:

(i) a first pivot point;

(ii) a second pivot point wherein an axis extending between said first and second pivot points and is not parallel to the linear motion of said redraw carriage;

(iii) four links of a first predetermined length forming a rhombus and defining in combination four pivot points at the intersection of adjacent links, wherein a first rhombus pivot point is connected to the redraw carriage;

(iv) a lever arm having a first end mounted for pivotal motion about said second pivot point and a second end downwardly depending therefrom, and on which lever arm is mounted a second rhombus pivot point, and wherein a third and forth rhombus pivot points are disposed between said first and second rhombus pivot points; said second pivot point being disposed between the first fixed pivot point and the second rhombus pivot point;

(v) first and second lateral links connected between said first pivot point and said third and forth rhombus pivot points, wherein the pivoting motion of said lever arm about said second pivot point is translated into the reciprocating linear motion of said ram.

6. In an apparatus for the manufacture of can bodies having:

(a) a frame;

(b) drive mechanism including a crank adapted for rotation about a first axis mounted in said frame;

(c) ram means mounted in said frame for reciprocal, straight line motion;

(d) rod means operatively connecting said crank with said ram means for imparting reciprocal motion to said ram means;

(e) ram guidance linkage means in mechanical communication with the ram means, said ram guidance linkage means comprising:

(i) a first pivot point (578);

(ii) a second pivot point (580) wherein an axis is defined between said first and second pivot points (578 and 580);

(iii) four links (582, 584, 586, 588) of a first predetermined length forming a rhombus and defining in combination four pivot points at the intersection of adjacent links, wherein a first rhombus pivot point (590) is on the ram means;

(iv) a lever arm having a first end mounted for pivotal motion about said second pivot point (580) and a second end downwardly depending therefrom, and on which lever arm is mounted a second rhombus pivot point (592), and wherein a third and forth rhombus pivot points (594 and 596) are disposed between said first and second rhombus pivot points; said second pivot point (580) being disposed between the first pivot point (578) and the second rhombus pivot point (592); and (v) first and second lateral links (598 and 600) connected between said first pivot point (578) and said third and forth rhombus pivot points (594 and 596), wherein the pivoting motion of said lever arm about said second pivot point (580) is translated into the reciprocating linear motion of said ram means.

* * * * *